US010605454B2

(12) United States Patent
Matsunaga et al.

(10) Patent No.: US 10,605,454 B2
(45) Date of Patent: Mar. 31, 2020

(54) EXHAUST STRUCTURE FOR COMBUSTION APPARATUS

(71) Applicant: NORITZ CORPORATION, Hyogo (JP)

(72) Inventors: Hironao Matsunaga, Amagasaki (JP); Masaki Sugatani, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 484 days.

(21) Appl. No.: 14/924,290

(22) Filed: Oct. 27, 2015

(65) Prior Publication Data

US 2017/0115001 A1 Apr. 27, 2017

(51) Int. Cl.
*F23J 13/02* (2006.01)
*F23J 13/04* (2006.01)
*E04D 13/143* (2006.01)

(52) U.S. Cl.
CPC ..... *F23J 13/025* (2013.01); *F23J 13/04* (2013.01); *E04D 13/143* (2013.01)

(58) Field of Classification Search
USPC ..... 454/45, 47; 126/85 B, 80, 312, 317; 285/42, 405, 418
See application file for complete search history.

(56) References Cited

U.S. PATENT DOCUMENTS 1,735,029 A * 11/1929 Zifferer ..... F16L 5/00 126/317
2,205,266 A 6/1940 Larrecq
2,272,428 A * 2/1942 Pedersen ..... F24D 5/08 126/317
2,898,839 A * 8/1959 McKann ..... E04D 13/1476 126/307 R
2,916,983 A * 12/1959 Kinkead ..... F23J 13/025 126/307 R
2,976,797 A * 3/1961 Newbill ..... F23J 11/00 126/307 R (Continued)

FOREIGN PATENT DOCUMENTS

JP 10-092243 A 4/1998
JP 2002-152949 A 5/2002

OTHER PUBLICATIONS

In Office Action issued by the U.S. Patent Office dated Oct. 11, 2016, which corresponds to U.S. Appl. No. 14/466,423 and is related to U.S. Appl. No. 14/924,290.

(Continued)

*Primary Examiner* — Steven B McAllister
*Assistant Examiner* — Frances F. Hamilton
(74) *Attorney, Agent, or Firm* — Studebaker & Brackett PC

(57) ABSTRACT

An exhaust structure for combustion apparatus includes an exhaust tube connected to a water heater, an exhaust pipe through which the exhaust tube is introduced, and an exhaust tube fixing member for fixing a position of the exhaust tube relative to the exhaust pipe. The exhaust tube fixing member includes a first fixing portion having a cylindrical shape and fixed to the exhaust tube, and an attaching portion connected to the first fixing portion and attached to the exhaust pipe. The attaching portion have a first cylindrical portion having a first inner diameter D2, and a second cylindrical portion having a second inner diameter D3 smaller than the first inner diameter D2 of the first cylindrical portion.

5 Claims, 10 Drawing Sheets

(56) References Cited

U.S. PATENT DOCUMENTS 3,315,586 A * 4/1967 Marrapese ..... F23L 17/04 126/307 R
3,430,549 A 3/1969 Hershey et al.
3,583,710 A * 6/1971 Burelle ..... F16L 17/035 277/615
3,796,445 A * 3/1974 Strott ..... F16L 47/28 285/4
4,069,668 A 1/1978 Oldberg
4,291,905 A * 9/1981 Schrock ..... F16L 5/02 248/56
4,481,935 A * 11/1984 Bawel ..... F23J 13/04 126/307 R
4,608,963 A * 9/1986 Townsend ..... F23J 13/025 126/307 R
4,651,710 A * 3/1987 Henault ..... F24H 9/06 126/116 B
4,846,147 A * 7/1989 Townsend ..... F23J 13/02 126/307 R
4,878,481 A * 11/1989 Schoeff ..... F23J 13/025 126/307 R
5,165,732 A * 11/1992 Townsend ..... F16L 13/163 126/307 R
5,186,503 A * 2/1993 von Feilitzen ..... F16L 58/185 285/148.17
5,680,856 A * 10/1997 van Dijk ..... F23J 13/025 126/307 R
5,791,980 A 8/1998 Kramer, Jr.
5,813,702 A * 9/1998 McGuire ..... E03C 1/102 285/148.23
6,406,066 B1 * 6/2002 Uegane ..... F01N 13/08 285/124.1
6,634,352 B2 10/2003 Maiello
7,032,933 B2 * 4/2006 Hellman ..... F16L 15/003 285/105
7,469,934 B2 * 12/2008 Inaba ..... F16L 39/00 285/124.3
D612,925 S * 3/2010 Kameyama ..... D23/393
8,490,351 B1 * 7/2013 Scott ..... E04D 13/1476 285/42
8,552,574 B2 * 10/2013 Sasaki ..... F23J 13/025 290/1 A
8,651,531 B2 * 2/2014 Michaels ..... A61M 1/0001 285/123.3
8,844,513 B2 * 9/2014 LaMunyon, III ..... F23J 13/00 126/299 R
8,881,689 B2 * 11/2014 Kameyama ..... F24H 1/28 122/19.2
9,228,689 B1 * 1/2016 Cline ..... F24F 7/02
9,896,847 B2 * 2/2018 Sugatani ..... E04D 13/178
2003/0024185 A1 * 2/2003 Menzies ..... E04D 13/14 52/219
2004/0239115 A1 * 12/2004 Wilk, Jr. ..... F16L 37/091 285/340
2006/0119099 A1 * 6/2006 Chiba ..... B21D 39/04 285/124.3
2006/0253971 A1 * 11/2006 Colin ..... A61H 33/6063 4/541.6
2008/0168727 A1 * 7/2008 Ledford ..... E02D 29/14 52/302.3
2011/0041934 A1 * 2/2011 Holler ..... F16L 39/005 137/561 R
2011/0275307 A1 * 11/2011 McIver ..... F24F 7/02 454/367
2012/0174878 A1 7/2012 English
2012/0216791 A1 * 8/2012 Munzenberger ..... H02G 3/088 126/314
2012/0272928 A1 11/2012 Kameyama
2013/0020796 A1 * 1/2013 Humber ..... E04D 13/1407 285/44
2014/0209087 A1 * 7/2014 Bertler ..... F23J 11/02 126/307 R
2015/0056903 A1 * 2/2015 Nagano ..... F16L 7/02 454/47
2015/0316258 A1 11/2015 Staller
2016/0053499 A1 * 2/2016 West ..... E04D 13/1476 52/218
2017/0284665 A1 * 10/2017 Sugatani ..... F23J 13/025

OTHER PUBLICATIONS

An Office Action issued by the U.S. Patent Office dated Apr. 20, 2018, which corresponds to U.S. Appl. No. 14/466,423 and is related to U.S. Appl. No. 14/924,290.

An Office Action issued by the U.S. Patent and Trademark Office dated Dec. 13, 2018, which corresponds to U.S. Appl. No. 14/466,423 and is related to U.S. Appl. No. 14/924,290.

* cited by examiner

EXHAUST STRUCTURE FOR COMBUSTION APPARATUS

BACKGROUND OF THE INVENTION

Field of the Invention

The present invention relates to an exhaust structure for a combustion apparatus.

Description of the Background Art

A combustion apparatus, for example, a water heater, a heating apparatus and the like, has a main body that is placed inside of a building such that an exhaust is emitted through an exhaust pipe (a B vent) to the outside of the building. There are locations where an already-placed exhaust pipe cannot be removed, from a point of view of maintaining appearance of buildings, when this already-placed combustion apparatus should be replaced with a new combustion apparatus.

At such a location, a new exhaust tube (a flexible exhaust tube) is inserted into the already-placed exhaust pipe without removing this already-placed exhaust pipe, so that a combustion apparatus can be replaced. However, if the exhaust tube has a relatively large outer diameter, this exhaust tube cannot be placed inside the exhaust pipe. Accordingly, an exhaust tube decreased in diameter needs to be used.

Furthermore, an exhaust tube inserted into the already-placed exhaust pipe needs to be fixed. In general, a grommet is used as a component for fixing a tube. For example, a grommet is disclosed in Japanese Patent Laying-Open Nos. 2002-152949 and 10-92243.

However, the grommet disclosed in the above-mentioned literatures may not be adapted to the diameter of the already-placed exhaust pipe and not be used for arrangement thereof. This may cause a problem that a member different from such a grommet needs to be additionally used.

SUMMARY OF THE INVENTION

The present invention has been made in light of the above-described problems. An object of the present invention is to provide an exhaust structure for a combustion apparatus, to which a diameter of an exhaust pipe can readily be adapted and by which this exhaust pipe can readily be arranged without having to use a separate member.

An exhaust structure for combustion apparatus according to the present invention includes an exhaust tube connected to a combustion apparatus, an exhaust pipe through which the exhaust tube is introduced, and an exhaust tube fixing member for fixing a position of the exhaust tube relative to the exhaust pipe. The exhaust tube fixing member includes a fixing portion having a cylindrical shape and fixed to the exhaust tube, and an attaching portion connected to the fixing portion and attached to the exhaust pipe. The attaching portion includes a first cylindrical portion having a first inner diameter and a second cylindrical portion having a second inner diameter smaller than the first inner diameter of the first cylindrical portion.

According to the exhaust structure for combustion apparatus of the present invention, the attaching portion has a first cylindrical portion and a second cylindrical portion that are different from each other in inner diameter. Accommodating the difference of diameter can therefore be facilitated even such a situation where the diameter of the already-placed exhaust pipe varies depending on the installation position.

In the exhaust structure for combustion apparatus described above, the exhaust tube fixing member is formed of an elastic body. Thereby, with the elasticity of the exhaust tube fixing member, the exhaust tube can readily be connected to the fixing portion, and also, the exhaust pipe can readily be attached to the attaching portion.

In the exhaust structure for combustion apparatus described above, the first cylindrical portion and the second cylindrical portion are arranged concentrically. Thereby, the exhaust tube and the exhaust pipe can be stably attached to the exhaust tube fixing member.

In the exhaust structure for combustion apparatus described above, the exhaust tube fixing member further includes a flange portion. The flange portion is provided in the first cylindrical portion and protrudes from the first cylindrical portion toward an outer circumferential side. Thereby, the exhaust tube fixing member can readily be fixed by the flange portion to a ceiling and the like inside the building.

The exhaust structure for combustion apparatus described above further includes a seal member arranged in contact with a surface of the flange portion and having an insertion portion through which the exhaust tube can be inserted. The seal member is configured to be elastically deformed and come in close contact with the exhaust tube in a state where the exhaust tube is inserted through the insertion portion. Thereby, the exhaust gas having leaked from the inside to the outside of the exhaust tube can be suppressed from leaking to the outside of the exhaust pipe.

In the exhaust structure for combustion apparatus described above, at least one cylindrical portion of the first cylindrical portion and the second cylindrical portion has a through hole penetrating through at least one cylindrical portion from an inner circumferential side to an outer circumferential side. Thereby, when the exhaust pipe is fixed to one of the first cylindrical portion and the second cylindrical portion, this one cylindrical portion is extended in the circumferential direction. At this time, the through hole is provided in one of the first and second cylindrical portions, so that a portion of this one cylindrical portion extended in the circumferential direction can be accommodated by this through hole. Thereby, the exhaust pipe can readily be fixed to one of the cylindrical portions.

Another exhaust structure for combustion apparatus of the present invention includes an exhaust tube connected to a combustion apparatus, an exhaust pipe through which the exhaust tube is introduced, and an exhaust tube fixing member for fixing a position of the exhaust tube relative to the exhaust pipe. The exhaust tube fixing member includes a fixing portion having a cylindrical shape and fixed to the exhaust tube, and a flange portion protruding at least from an outer circumference of the fixing portion toward an outer circumferential side.

According to another exhaust structure for combustion apparatus of the present invention, the exhaust tube fixing member can readily be fixed by the flange portion to a ceiling and the like inside the building, so that the already-placed exhaust pipe can readily be arranged.

In another exhaust structure for combustion apparatus described above, the exhaust tube fixing member is formed of an elastic body. Thereby, the exhaust tube can readily be connected to the fixing portion with the elasticity of the exhaust tube fixing member.

Another exhaust structure for combustion apparatus described above further includes a seal member arranged in contact with a surface of the flange portion and having an insertion portion through which the exhaust tube can be inserted. The seal member is configured to be elastically deformed and come in close contact with the exhaust tube in a state where the exhaust tube is inserted through the insertion portion. Thereby, the exhaust gas having leaked from the inside to the outside of the exhaust tube can be suppressed from leaking to the outside of the exhaust pipe.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be hereinafter described with reference to the drawings.

An exhaust structure for a combustion apparatus in one embodiment of the present invention will be first described.

Figure 1:
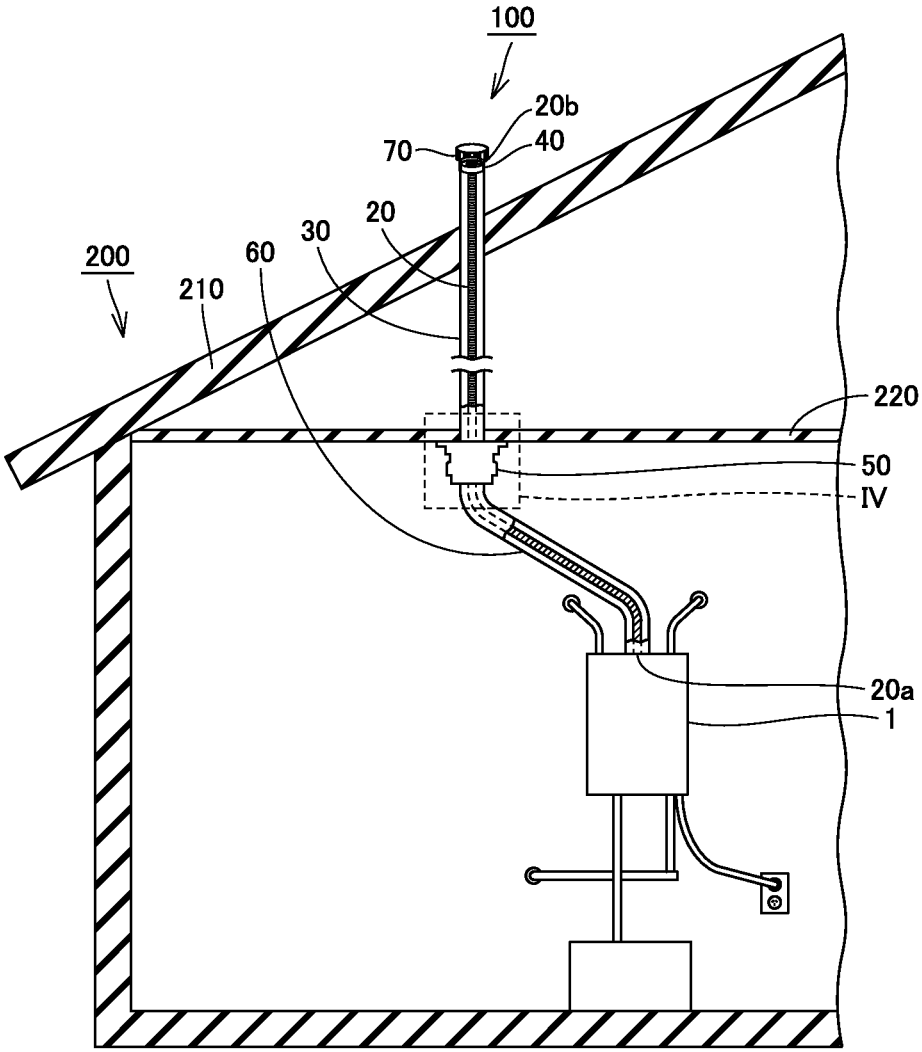
FIG. 1 is a diagram schematically showing the state where an exhaust structure for combustion apparatus in one embodiment of the present invention is placed in a building.

As shown in FIG. 1, an exhaust structure for combustion apparatus 100 in the present embodiment mainly has a combustion apparatus 1, an exhaust tube (flexible exhaust tube) 20, an exhaust pipe (B-vent) 30, an exhaust adapter 40, an exhaust tube fixing member 50, a connection pipe 60, and an exhaust terminal (rain cap) 70. This exhaust structure for combustion apparatus 100 serves to emit combustion gas produced in combustion apparatus 1 to the outside of a building 200.

Combustion apparatus 1 is placed inside building 200. This combustion apparatus 1 serves as a water heater that heats warm water and water, for example, with combustion gas, and may be a heating apparatus or the like that warms up the inside of the building with combustion gas. Furthermore, in the case where a water heater is used as combustion apparatus 1, this water heater may be, for example, a water heater adapted to an exhaust suction and combustion system. This water heater may also be a water heater of a latent heat recovery type.

Exhaust tube 20 has one end portion 20*a* and the other end portion 20*b*. Exhaust tube 20 is connected to combustion apparatus 1 at one end portion 20*a*. The other end portion 20*b* of exhaust tube 20 extends to the outside of the building. The inside of exhaust tube 20 is defined as an emission path for the combustion gas emitted from combustion apparatus 1. Thus, the combustion gas produced in combustion apparatus 1 can be guided to the outside of the building through exhaust tube 20.

Exhaust tube 20 is implemented as a flexible pipe such as an accordion pipe, but may be a spiral pipe and the like. This allows exhaust tube 20 to conform also to the shape of exhaust pipe 30 having a complicated shape. Furthermore, since an exhaust flows through exhaust tube 20, this exhaust tube 20 can be suitably made of a material having acidic resistance. This is because acidic drainage water may be discharged together with an exhaust in the case where combustion apparatus 1 is a water heater of a latent heat recovery type as in the present embodiment.

Accordingly, exhaust tube 20 can be made of a material having acidic resistance such as phenol resin, epoxy resin, silicone resin, fluorine resin such as polytetrafluoroethylene, unsaturated polyester resin, melamine resin, polycarbonate resin, methacryl styrene (MS) resin, methacryl resin, styrene acrylonitrile copolymer (AS) resin, ABS resin, polyethylene, polypropylene, polystyrene, polyethylene terephthalate (PET), and vinyl chloride resin, for example.

Exhaust pipe 30 is attached to building 200 so as to extend from the inside to the outside, for example, through a roof 210 of building 200. Exhaust pipe 30 may extend from the inside to the outside through a wall. Exhaust pipe 30 is greater in outer diameter than exhaust tube 20. In the inside of this exhaust pipe 30, a part of exhaust tube 20 on the side of the other end portion 20*b* is inserted. Exhaust pipe 30 is formed of metal, for example. Exhaust pipe 30 is connected to exhaust tube fixing member 50 on the lower end side.

Furthermore, exhaust pipe 30 is connected to exhaust terminal 70 on the upper end side.

Exhaust adapter 40 is located on the other end portion 20*b* side of exhaust tube 20 and also on the upper end side of exhaust pipe 30. Exhaust adapter 40 has an annular shape that surrounds a through hole. Exhaust adapter 40 is attached to the outer circumferential surface of exhaust tube 20 and also to the inner circumferential surface of exhaust pipe 30 by inserting exhaust tube 20 into the through hole. Specifically, this exhaust adapter 40 is fitted on the outer circumferential surface of exhaust tube 20 and fitted on the inner circumferential surface of exhaust pipe 30. Exhaust adapter 40 has an inner circumferential surface that presses the outer circumferential surface of exhaust tube 20 in the state where this exhaust adapter 40 is fitted on the outer circumferential surface of exhaust tube 20; and an outer circumferential surface that presses the inner circumferential surface of exhaust pipe 30 in the state where exhaust adapter 40 is fitted on the inner circumferential surface of exhaust pipe 30.

Consequently, the inner circumferential surface of exhaust adapter 40 comes into close contact with the outer circumferential surface of exhaust tube 20 while the outer circumferential surface of exhaust adapter 40 comes into close contact with the inner circumferential surface of exhaust pipe 30. Accordingly, exhaust adapter 40 can fix exhaust tube 20 to exhaust pipe 30, and also, can prevent combustion gas or drainage water from leaking through between exhaust tube 20 and exhaust pipe 30 and flowing back into the room.

The above-described configuration can readily be achieved, for example, by exhaust adapter 40 made of an elastic material. This elastic material is for example preferably a soft resin, or for example preferably EPDM (Ethylene-Propylene-Diene Monomer), soft PVC (polyvinyl chloride), silicone rubber, fluororubber, chloroprene rubber (CR), butyl rubber (IIR), or the like. Furthermore, exhaust adapter 40 may be made of one type elastic material, or may be made of a combination of a plurality of different types of elastic materials.

Exhaust terminal 70 is attached to a tip end of exhaust pipe 30 on the outside of the building. Exhaust terminal 70 has a circumferential wall that is provided with an exhaust port through which combustion gas is emitted to the outside (outdoors). This exhaust port allows the combustion gas guided through exhaust tube 20 to be emitted from exhaust terminal 70 to the outside of building 200 through exhaust pipe 30.

Exhaust terminal 70 may be an outer cover attached on the outer circumferential side of exhaust pipe 30 or may be an inner cover attached on the inner circumferential side of exhaust pipe 30. Exhaust terminal 70 is made, for example, of such a material as aluminum or stainless steel.

Connection pipe 60 serves to cover exhaust tube 20 to protect this exhaust tube 20. Connection pipe 60 is connected to exhaust tube fixing member 50 and combustion apparatus 1. Connection pipe 60 is greater in outer diameter than exhaust tube 20. A part of exhaust tube 20 on the side of one end portion 20*a* is introduced into connection pipe 60.

It is to be noted that connection pipe 60 is implemented as a flexible pipe such as an accordion pipe, but may be a spiral pipe. Connection pipe 60 has flexibility, thereby allowing this connection pipe 60 to readily conform to the shape of exhaust tube 20. Furthermore, connection pipe 60 and combustion apparatus 1 can readily be connected.

Furthermore, connection pipe 60 may be a pipe made of aluminum, for example. In this case, since connection pipe 60 can be reduced in weight, the load on exhaust tube fixing member 50 supporting connection pipe 60 can be decreased. Also, since connection pipe 60 has a certain degree of hardness, it becomes possible to suppress deformation of connection pipe 60 caused by its self-weight. Furthermore, since the pipe made of aluminum can be relatively readily processed, for example, cut and the like, it can readily be adapted to the length of exhaust tube 20, for example. Exhaust tube fixing member 50 serves to fix exhaust tube 20 to exhaust pipe 30.

Exhaust tube fixing member 50 is attached to exhaust pipe 30 at a position close to combustion apparatus 1 relative to exhaust adapter 40. Furthermore, exhaust tube fixing member 50 fixes connection pipe 60 to exhaust pipe 30. Furthermore, it is preferable that exhaust tube fixing member 50 is fixed to a ceiling 220 of building 200 in the state where it is fixed to both of exhaust tube 20 and exhaust pipe 30.

Then, the configuration of the above-described exhaust tube fixing member 50 will be hereinafter described with reference to FIGS. 2 and 3.

Figure 2:
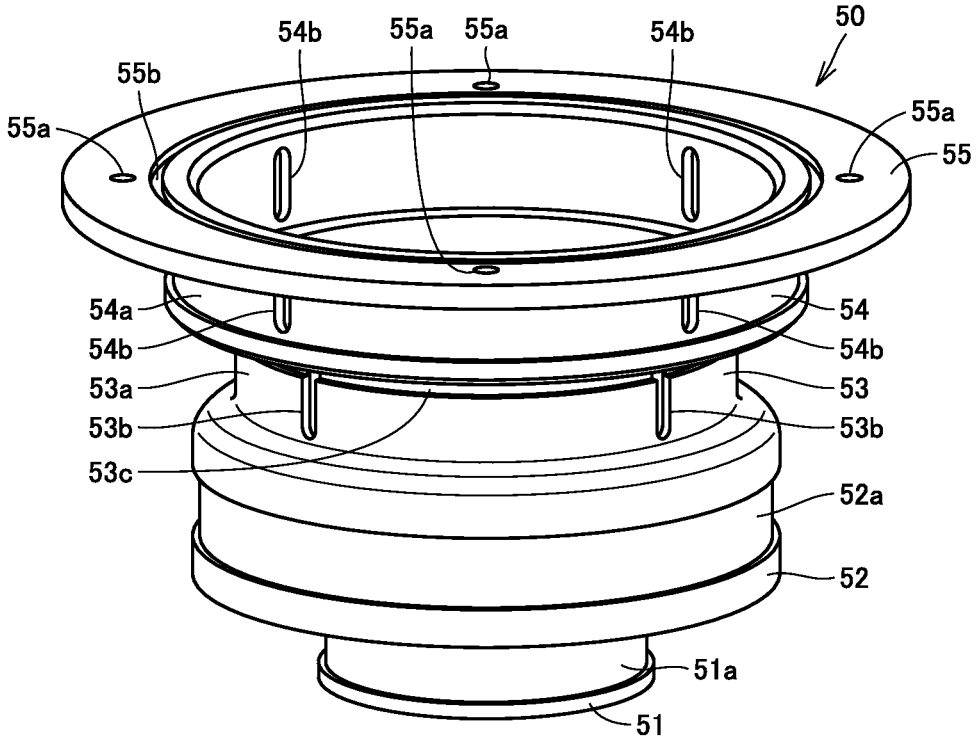
FIG. 2 is a perspective view schematically showing the configuration of an exhaust tube fixing member included in the exhaust structure for combustion apparatus in one embodiment of the present invention.
Figure 3:
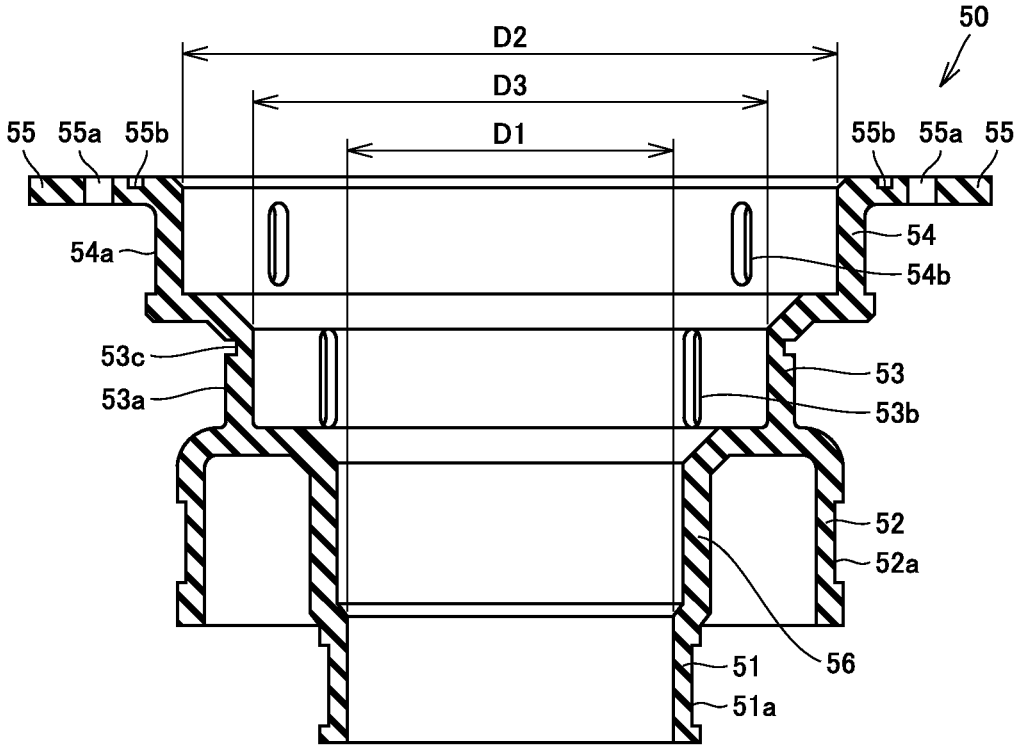
FIG. 3 is a cross-sectional view schematically showing the configuration of the exhaust tube fixing member included in the exhaust structure for combustion apparatus in one embodiment of the present invention.

As shown in FIGS. 2 and 3, exhaust tube fixing member 50 includes a first fixing portion 51, attaching portions 53 and 54, a second fixing portion 52, a flange portion 55, and a connection portion 56. First fixing portion 51 serves to fix exhaust tube 20. First fixing portion 51 has a tubular shape, and preferably, has a cylindrical shape. First fixing portion 51 has an outer circumferential surface on which a groove 52*a* for a band is provided, in which a binding band is fitted.

Attaching portions 53 and 54 each serve to attach exhaust pipe 30. Attaching portions 53 and 54 include a first cylindrical portion 54 and a second cylindrical portion 53. The lower end of first cylindrical portion 54 is connected to the upper end of second cylindrical portion 53. Each of first cylindrical portion 54 and second cylindrical portion 53 has a tubular shape, and preferably, has a cylindrical shape.

First cylindrical portion 54 has a first inner diameter D2. Second cylindrical portion 53 has a second inner diameter D3 smaller than first inner diameter D2 of first cylindrical portion 54. First inner diameter D2 of first cylindrical portion 54 and second inner diameter D3 of second cylindrical portion 53 are designed to be greater than an inner diameter D1 of first fixing portion 51.

At least one of first cylindrical portion 54 and second cylindrical portion 53 is provided with through holes 54*b* and 53*b*. In the present embodiment, first cylindrical portion 54 is provided with a plurality of through holes 54*b* while second cylindrical portion 53 is provided with a plurality of through holes 53*b*. Each through hole 54*b* penetrates through first cylindrical portion 54 from the inner circumferential side to the outer circumferential side. Each through hole 53*b* penetrates through second cylindrical portion 53 from the inner circumferential side to the outer circumferential side. It is to be noted that a through hole may be provided in only one of first cylindrical portion 54 and second cylindrical portion 53.

First cylindrical portion 54 has an outer circumferential surface on which a groove 54*a* for a band is provided, in which a binding band is fitted. Second cylindrical portion 53 has an outer circumferential surface on which a groove 53*a* for a band is provided, in which a binding band is fitted. Furthermore, on the outer circumferential surface at the upper end of second cylindrical portion 53, a groove 53*c* for cutting or a mark for cutting may be provided along its circumference.

Connection portion 56 connects between first fixing portion 51 and second cylindrical portion 53. The lower end of connection portion 56 is connected to the upper end of first fixing portion 51 while the upper end of connection portion 56 is connected to the lower end of second cylindrical portion 53. Connection portion 56 has a tubular shape, and preferably, has a cylindrical shape. Connection portion 56 has an inner diameter larger than inner diameter D1 of first fixing portion 51.

Second fixing portion 52 serves to fix connection pipe 60. The upper end of second fixing portion 52 is connected to the upper end of connection portion 56 and the lower end of second cylindrical portion 53. Furthermore, second fixing portion 52 surrounds the entire outer circumference of connection portion 56. Second fixing portion 52 has a tubular shape, and preferably, has a cylindrical shape. Second fixing portion 52 has an outer circumferential surface on which a groove 52*a* for a band is provided, in which a binding band is fitted.

First fixing portion 51, first cylindrical portion 54, second cylindrical portion 53, second fixing portion 52, and connection portion 56 are arranged concentrically. This allows communication among inside holes of first fixing portion 51, first cylindrical portion 54, second cylindrical portion 53, and connection portion 56, thereby forming a through hole that penetrates through exhaust tube fixing member 50 in the vertical direction.

Flange portion 55 is connected to the upper end of first cylindrical portion 54. Flange portion 55 protrudes from the outer circumferential surface of first cylindrical portion 54 toward the outer circumferential side. Flange portion 55 has an annular shape. Flange portion 55 is provided with a plurality of through holes 55*a* through which a fixing member such as a bolt is introduced. On the upper end surface of flange portion 55 (the surface of flange portion 55), a groove 55*b* for cutting or a mark for cutting may be provided along its circumference.

Exhaust tube fixing member 50 is formed of an elastic body. The material of this elastic body is for example preferably a soft resin, or for example preferably EPDM (Ethylene-Propylene-Diene Monomer), soft PVC (polyvinyl chloride), silicone rubber, fluororubber, chloroprene rubber (CR), butyl rubber (IIR), or the like. Furthermore, exhaust tube fixing member 50 may be made of one type elastic material, or may be made of a combination of a plurality of different types of elastic materials.

Then, fixation of exhaust tube 20, exhaust pipe 30 and connection pipe 60 to exhaust tube fixing member 50 will be hereinafter described with reference to FIGS. 4 and 5.

First fixing portion 51 is connected to exhaust tube 20. Specifically, exhaust tube 20 is introduced into a first fixing portion 51 having a cylindrical shape, and the inner circumferential surface of first fixing portion 51 comes in contact with the outer circumferential surface of exhaust tube 20. In other words, first fixing portion 51 is fitted around exhaust tube 20. First fixing portion 51 is formed to have inner diameter D1 smaller than the outer diameter of exhaust tube 20, so that exhaust tube 20 can be fixed with the elastic force of first fixing portion 51.

In the present embodiment, a binding band 81 is tightened to squeeze the outer circumferential surface of first fixing portion 51, so that the inner circumferential surface of first fixing portion 51 is brought firmly into contact with the outer circumferential surface of exhaust tube 20. Thereby, exhaust tube 20 can be firmly fixed by first fixing portion 51.

First cylindrical portion 54 is connected to exhaust pipe 30. Specifically, a part of exhaust pipe 30 at its lower end is introduced into cylindrically-shaped first cylindrical portion 54, and the inner circumferential surface of first cylindrical portion 54 comes in contact with the outer circumferential surface of exhaust pipe 30. In other words, first cylindrical portion 54 is fitted around exhaust pipe 30. First cylindrical portion 54 is formed to have inner diameter D2 smaller than the outer diameter of exhaust pipe 30, so that exhaust pipe 30 can be fixed with the elastic force of first cylindrical portion 54.

In the present embodiment, a binding band 83 is tightened to squeeze the outer circumferential surface of first cylindrical portion 54, so that the inner circumferential surface of first cylindrical portion 54 is brought firmly into contact with the outer circumferential surface of exhaust pipe 30. Thereby, exhaust pipe 30 can be firmly fixed by first cylindrical portion 54.

Second fixing portion 52 is connected to connection pipe 60. Specifically, a part of connection pipe 60 at its upper end is introduced into cylindrically-shaped second fixing portion 52, and the inner circumferential surface of second fixing portion 52 comes in contact with the outer circumferential surface of connection pipe 60. In other words, second fixing portion 52 is fitted around connection pipe 60. Second fixing portion 52 is formed to have an inner diameter smaller than the outer diameter of connection pipe 60, so that connection pipe 60 can be fixed with the elastic force of second fixing portion 52.

According to the present embodiment, a binding band 82 is tightened to squeeze the outer circumferential surface of second fixing portion 52, so that the inner circumferential surface of second fixing portion 52 is brought firmly into contact with the outer circumferential surface of connection pipe 60. Thereby, connection pipe 60 can be firmly fixed by second fixing portion 52.

Flange portion 55 is attached to ceiling 220 of the building. Specifically, a fixing member such as a screw 85 is inserted from below into a through hole 55*a* of flange portion 55, and screwed into the ceiling located above flange portion 55. Thereby, exhaust tube fixing member 50 is attached to ceiling 220 by the fixing member.

Although an explanation has been given in the above description with regard to the case where the already-placed exhaust pipe 30 has a relatively large outer diameter (for example, 4 inches), exhaust pipe 30 may have a relatively small outer diameter (for example, 3 inches). In that case, exhaust tube fixing member 50 is connected to exhaust pipe 30, as will be hereinafter described with reference to FIG. 5.

Figure 5:
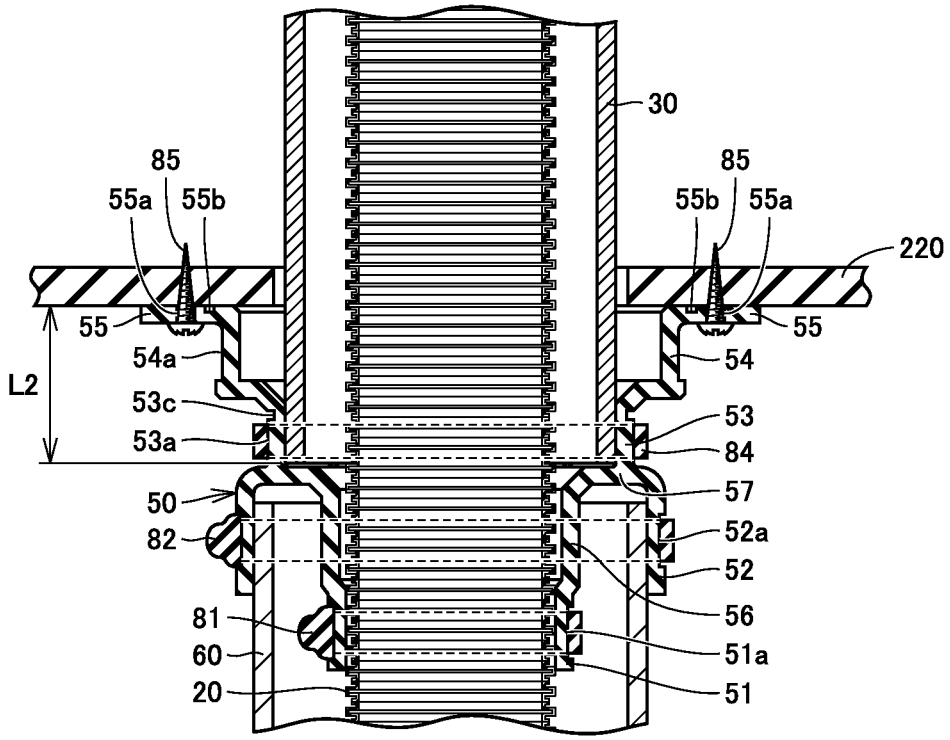
FIG. 5 is a cross-sectional view showing, in an enlarged manner, another example of region IV in FIG. 1.

As shown in FIG. 5, in the case where exhaust pipe 30 has a relatively small outer diameter, exhaust pipe 30 is connected to second cylindrical portion 53. Specifically, a part of exhaust pipe 30 at its lower end is introduced into second cylindrical portion 53 formed in a cylindrical shape, and the inner circumferential surface of second cylindrical portion 53 comes in contact with the outer circumferential surface of exhaust pipe 30. In other words, second cylindrical portion 53 is fitted around exhaust pipe 30. Second cylindrical portion 53 is formed to have inner diameter D3 smaller than the outer diameter of exhaust pipe 30, so that exhaust pipe 30 can be fixed with the elastic force of second cylindrical portion 53.

In the present embodiment, a binding band 84 is tightened to squeeze the outer circumferential surface of second cylindrical portion 53, so that the inner circumferential surface of second cylindrical portion 53 is brought firmly into contact with the outer circumferential surface of exhaust pipe 30. Thereby, exhaust pipe 30 can be firmly fixed by second cylindrical portion 53.

Figure 4:
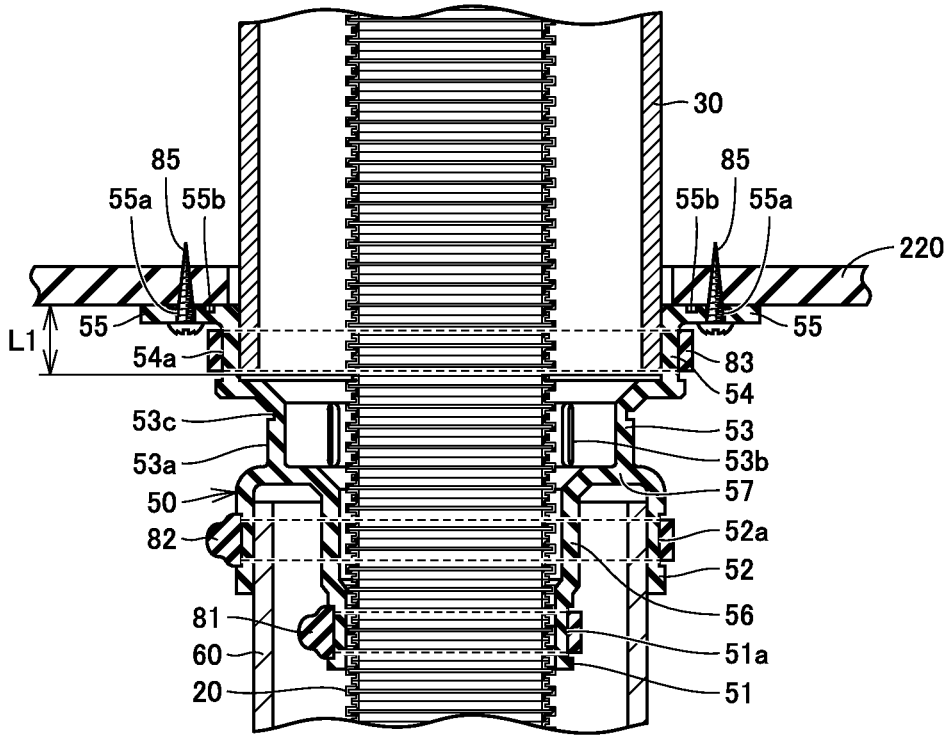
FIG. 4 is a cross-sectional view showing, in an enlarged manner, one example of a region IV in FIG. 1.

In addition, connection of exhaust tube 20, connection of connection pipe 60, and attachment of exhaust tube fixing member 50 to ceiling 220 other than the above are the same as those in the state shown in FIG. 4, and therefore, the description thereof will not be repeated.

Although an explanation has been given in the above description with regard to the case where exhaust tube fixing member 50 can be attached to ceiling 220, there may be a case where exhaust tube fixing member 50 cannot be attached to ceiling 220. Referring to FIGS. 6 to 9, hereinafter described will be the case where exhaust tube fixing member 50 cannot be attached to ceiling 220.

Figure 6:
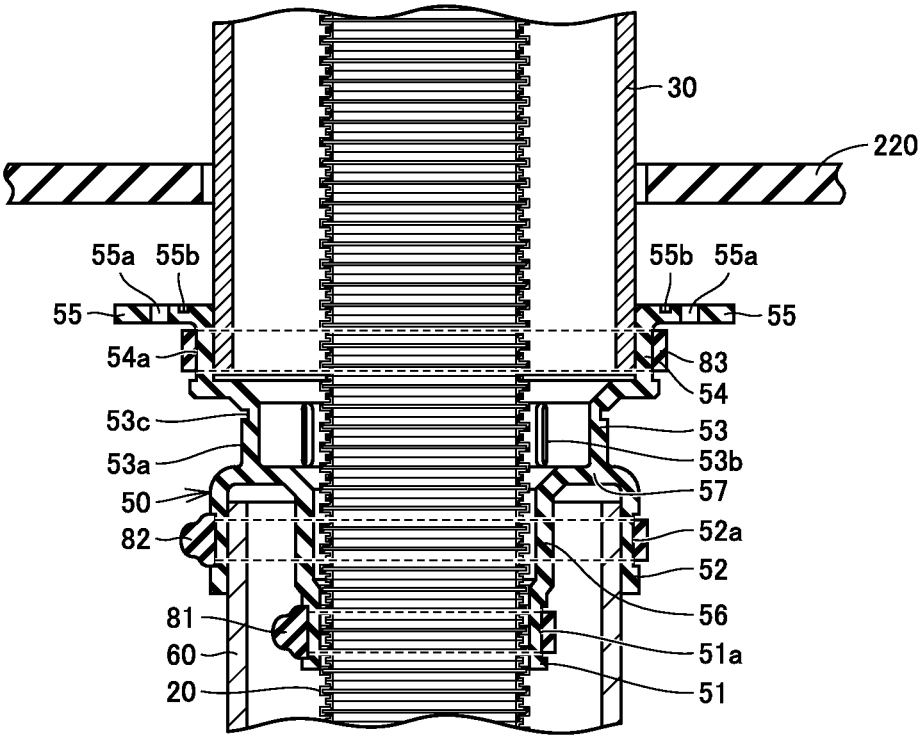
FIG. 6 is a cross-sectional view showing the state of one example in which a flange portion of the exhaust tube fixing member is located at a distant from a ceiling surface.

As shown in FIG. 6, in the case where a portion of exhaust pipe 30 that protrudes downward from ceiling 220 is relatively large, flange portion 55 of exhaust tube fixing member 50 cannot be brought into contact with ceiling 220. Therefore, exhaust tube fixing member 50 cannot be attached to ceiling 220. In this case, exhaust tube fixing member 50 is maintained at a distance from ceiling 220.

Figure 7:
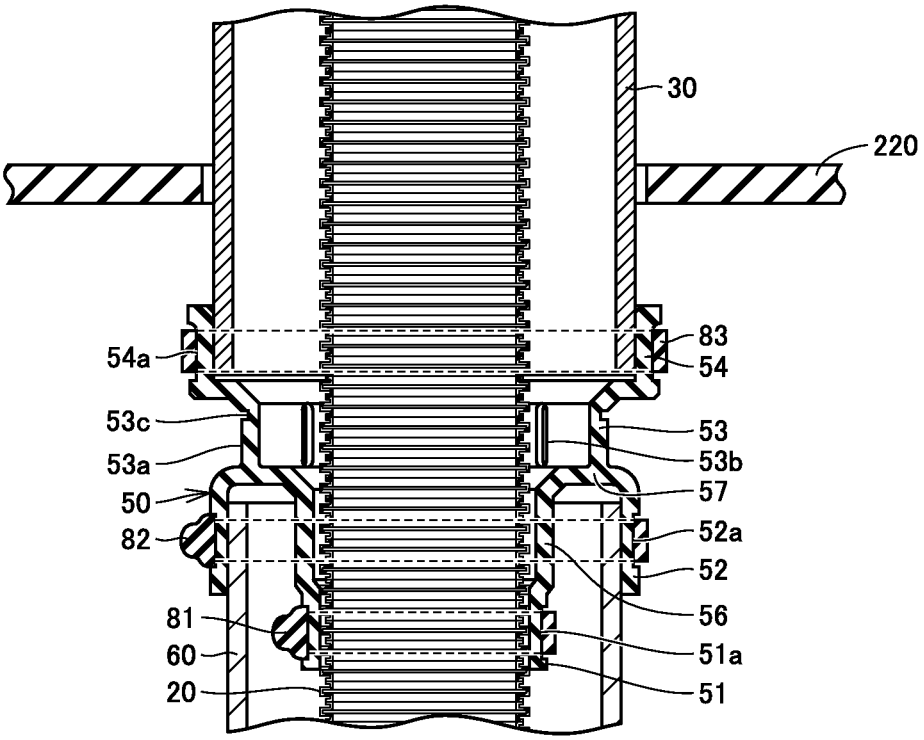
FIG. 7 is a cross-sectional view showing the state of one example in which the flange portion is removed from the state shown in FIG. 6.

Furthermore, in the case where flange portion 55 impedes installation or impairs the aesthetic appearance, flange portion 55 may be cut out from exhaust tube fixing member 50. Flange portion 55 is removed by cutting this flange portion 55 out from exhaust tube fixing member 50 along groove 55*b* for cutting or a mark for cutting provided in the upper end surface of flange portion 55 (the surface of flange portion 55). As shown in FIG. 7, flange portion 55 is cut out from exhaust tube fixing member 50 as described above, thereby removing the portion of exhaust tube fixing member 50 that protrudes toward the outer circumferential side. Consequently, installation can readily be carried out while uncomplicated and excellent aesthetic appearance can be achieved.

Figure 8:
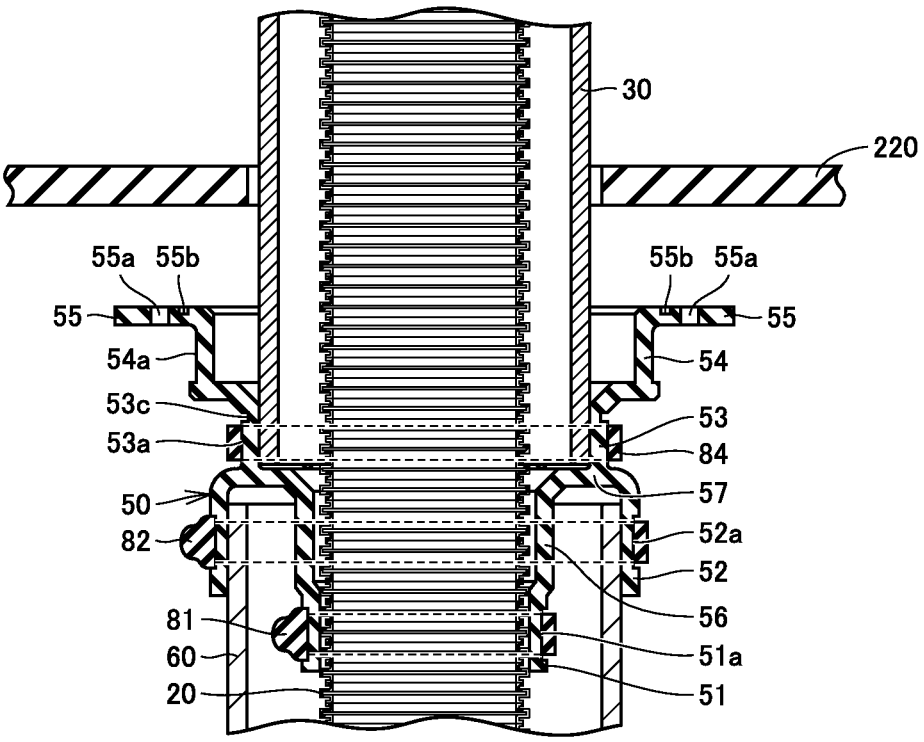
FIG. 8 is a cross-sectional view showing the state of another example in which the flange portion of the exhaust tube fixing member is located at a distant from the ceiling surface.
Figure 9:
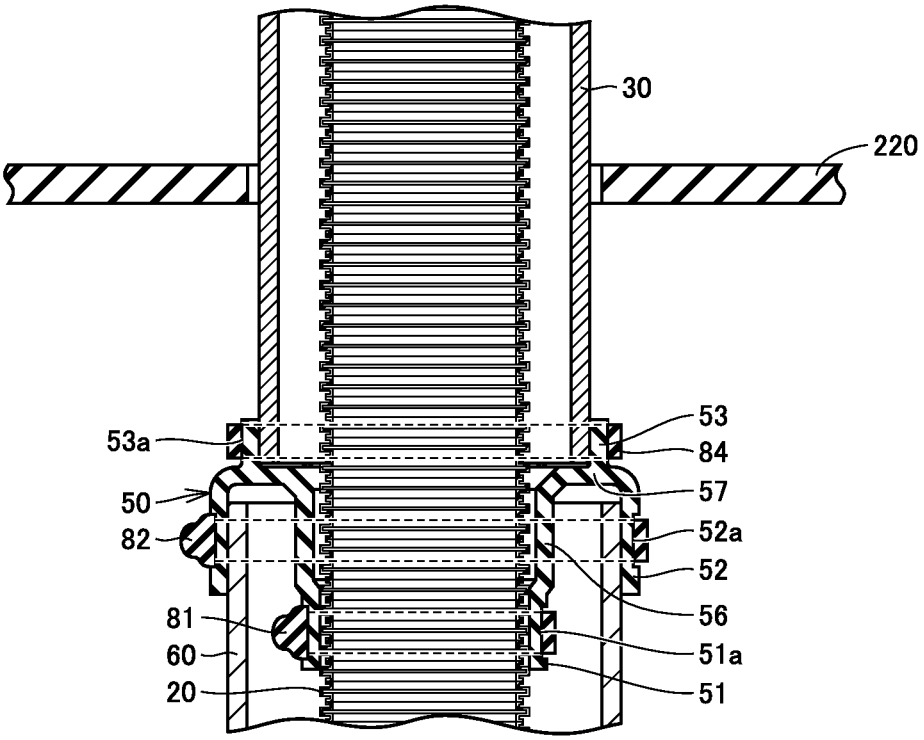
FIG. 9 is a cross-sectional view showing the state of another example in which the flange portion is removed from the state shown in FIG. 8.

Although an explanation has been given in the above description with regard to the case where the already-placed exhaust pipe 30 has a relatively large outer diameter (for example, 4 inches), the same applies also to the case where exhaust pipe 30 has a relatively small outer diameter (for example, 3 inches), as shown in FIGS. 8 and 9. In this case, as shown in FIG. 8, flange portion 55 may be cut out from exhaust tube fixing member 50 along groove 53*c* for cutting or a mark for cutting provided in the outer circumferential surface of second cylindrical portion 53.

As shown in FIG. 9, flange portion 55 is cut out from exhaust tube fixing member 50 as described above, thereby removing the portion of exhaust tube fixing member 50 that protrudes toward the outer circumferential side. Consequently, installation can readily be carried out while uncomplicated and excellent aesthetic appearance can be achieved.

Figure 10:
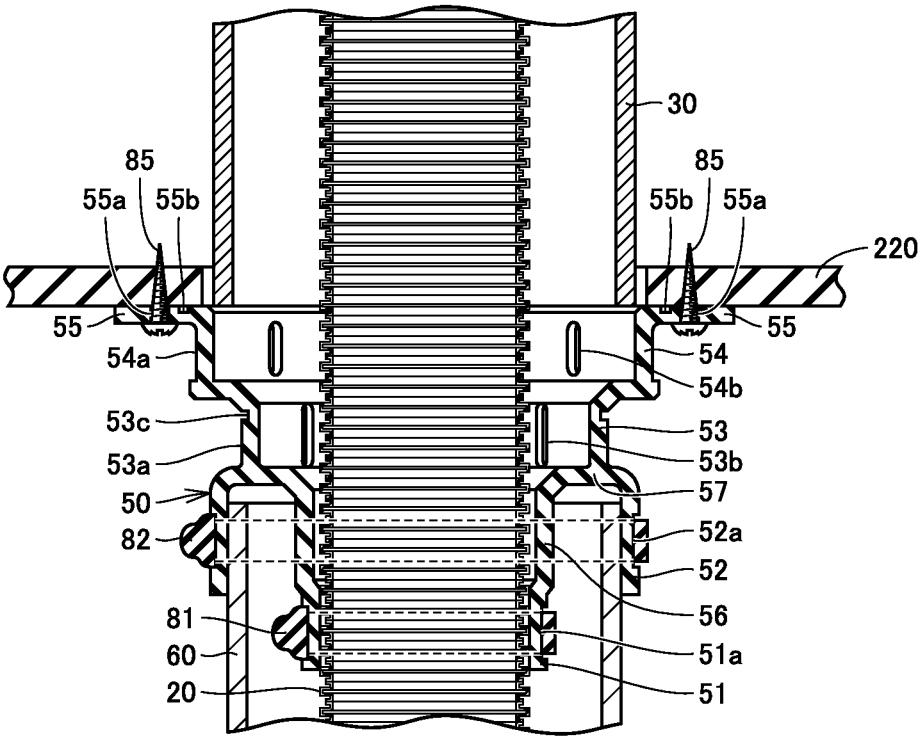
FIG. 10 is a cross-sectional view showing the state in which an exhaust pipe is not introduced into the exhaust tube fixing member.

Although an explanation has been given in the above description with regard to the case where exhaust pipe 30 protrudes downward from ceiling 220, exhaust pipe 30 may not protrude from ceiling 220 as shown in FIG. 10. In this case, a gap is produced between exhaust pipe 30 and exhaust tube fixing member 50.

Exhaust structure for combustion apparatus 100 is designed such that negative pressure occurs within exhaust pipe 30 so as to prevent, as much as possible, exhaust gas from leaking to the outside of exhaust pipe 30 when cracking or the like occurs in exhaust tube 20. Accordingly, it is necessary to prevent a gap from being produced between exhaust pipe 30 and exhaust tube fixing member 50 as described above. Thus, a seal member 90 as shown in FIG. 11 is employed.

Figure 11:
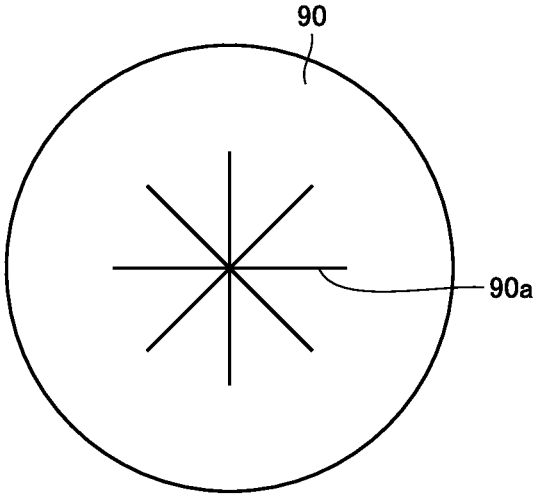
FIG. 11 is a plan view showing the configuration of a seal member.

As shown in FIG. 11, seal member 90 is formed of a circular flat plate, for example. Seal member 90 has an insertion portion 90*a* through which exhaust tube 20 is inserted into the center of its circular shape. This insertion portion 90*a* serves as a radially-shaped cut 90*a*, for example. Seal member 90 has an outer diameter larger than inner diameter D2 of first cylindrical portion 54. Furthermore, seal member 90 is formed of an elastic material.

This elastic material is for example preferably a soft resin, or for example preferably EPDM, soft PVC, silicone rubber, fluororubber, chloroprene rubber, butyl rubber, or the like. Furthermore, seal member 90 may be made of one type elastic material, or may be made of a combination of a plurality of different types of elastic materials.

Seal member 90 is configured so as to be elastically deformed and come in close contact with exhaust tube 20 in the state where exhaust tube 20 is inserted through insertion portion 90*a*.

Figure 12:
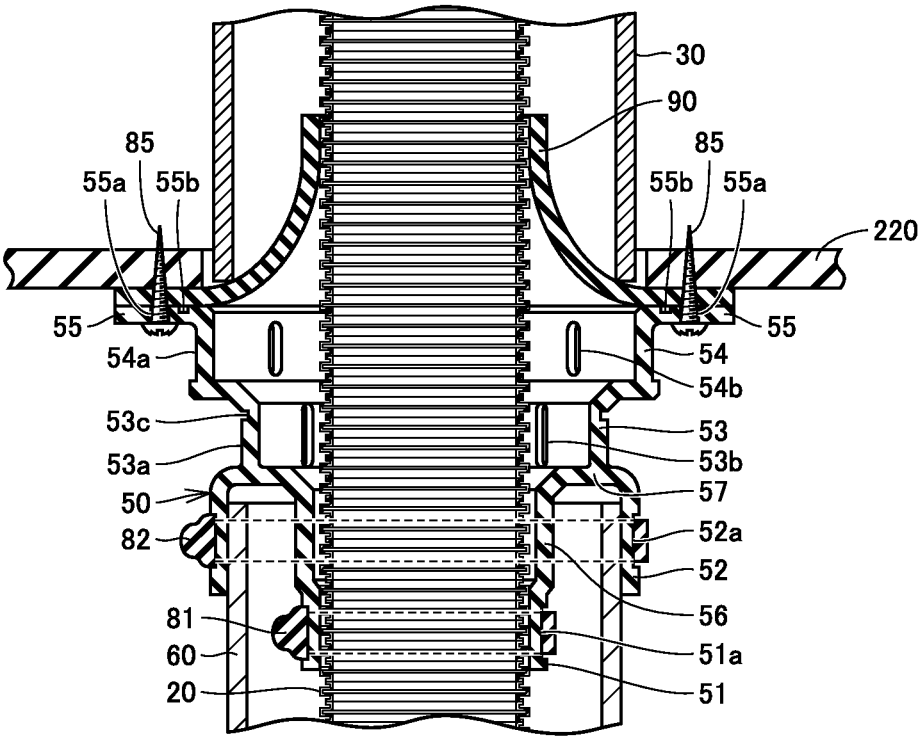
FIG. 12 is a cross-sectional view showing the configuration in which the seal member shown in FIG. 11 is arranged between the flange portion of the exhaust tube fixing member and the ceiling surface.

As shown in FIG. 12, seal member 90 is arranged between flange portion 55 and ceiling 220. Exhaust tube 20 is introduced from below into insertion portion 90*a* of this seal member 90, so that radially-shaped cut 90*a* is opened and brought into close contact with the outer circumferential surface of exhaust tube 20. Thereby, the exhaust gas having leaked from the inside to the outside of exhaust tube 20 can be suppressed from leaking to the outside of exhaust pipe 30.

Furthermore, in the case where exhaust pipe 30 is formed of a single pipe, the exhaust gas can be suppressed by this seal member 90 from leaking to the outside of exhaust pipe 30, and also, the inside of exhaust pipe 30 can readily be maintained at negative pressure.

Furthermore, the configuration of seal member 90 is not limited to the configuration in FIG. 11, but may be a configuration shown in FIG. 13, 14, or 15A, 15B.

Figure 13:
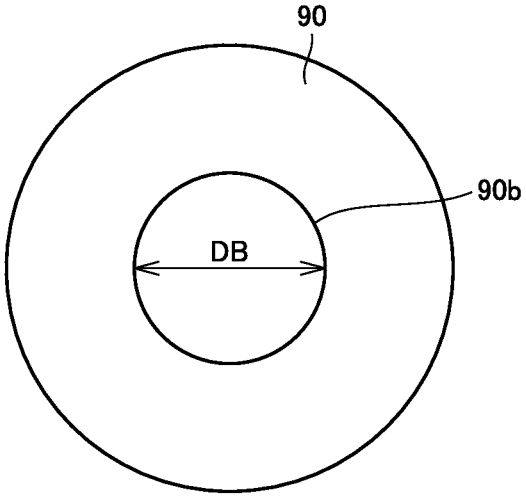
FIG. 13 is a plan view showing the configuration of another first example of the seal member.

As shown in FIG. 13, seal member 90 may have an annular shape that is provided in its center with a through hole 90*b* as an insertion portion. Through hole 90*b* is formed to have a diameter DB smaller than the outer diameter of exhaust tube 20. Thereby, exhaust tube 20 is introduced into through hole 90*b* of seal member 90, so that the inner circumference of seal member 90 can be brought into close contact with the outer circumferential surface of exhaust tube 20 with the elastic force of seal member 90.

Figure 14:
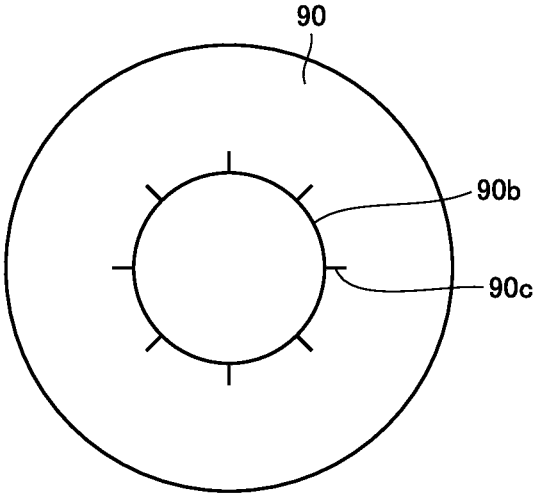
FIG. 14 is a plan view showing the configuration of another second example of the seal member.

As shown in FIG. 14, seal member 90 may have an annular shape that is provided in its center with through hole 90*b* and radially-shaped cut 90*c* as an insertion portion. This through hole 90*b* is formed to have a diameter smaller than the outer diameter of exhaust tube 20. Thereby, exhaust tube 20 is introduced into through hole 90*b* of seal member 90, so that the inner circumference of seal member 90 can be brought into close contact with the outer circumferential surface of exhaust tube 20 with the elastic force of seal member 90. Furthermore, the inner circumference of seal member 90 may be deformed by cut 90*c* so as to be flexibly brought into close contact with the outer circumferential surface of exhaust tube 20.

Figure 15A:
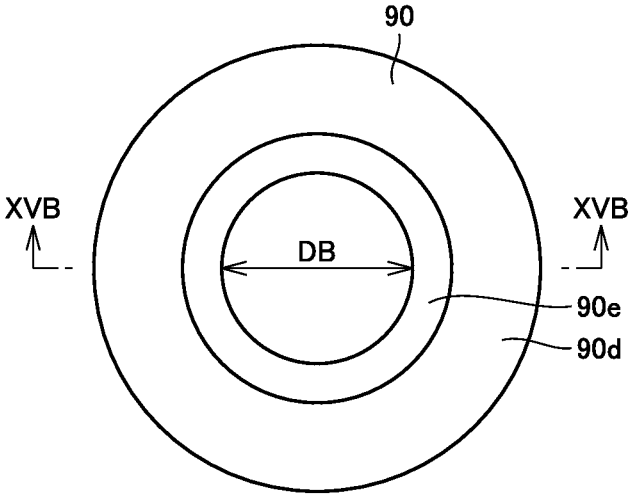
FIG. 15A is a plan view showing the configuration of another third example of the seal member.
Figure 15B:
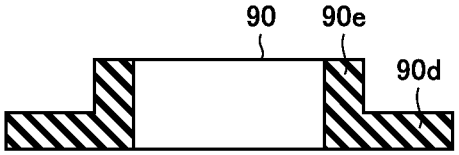
FIG. 15B is a cross-sectional view showing the configuration of another third example of the seal member.

As shown in FIGS. 15A and 15B, seal member 90 may have an annular shape that is provided in its center with, as an insertion portion, a through hole and a thickness portion 90*e* surrounding this through hole. Thickness portion 90*e* is provided in an annular shape on the innermost circumference of seal member 90, and formed to be thicker than annular-shaped outer circumferential portion 90*d* located on the outer circumferential side of thickness portion 90*e*. The through hole is formed to have diameter DB smaller than the outer diameter of exhaust tube 20. Thereby, exhaust tube 20 is introduced into the through hole of seal member 90, so that the inner circumference of seal member 90 can be brought into close contact with the outer circumferential surface of exhaust tube 20 with the elastic force of seal member 90. Furthermore, thickness portion 90*e* allows an increase in length of close contact between the inner circumferential surface of seal member 90 and the outer circumferential surface of exhaust tube 20.

Combustion apparatus 1 used in exhaust structure for combustion apparatus 100 described above may be a water heater of a latent heat recovery type, for example, adapted to an exhaust suction and combustion system, as described above. The configuration of the water heater of a latent heat recovery type adapted to the exhaust suction and combustion system will be described below.

Figure 16:
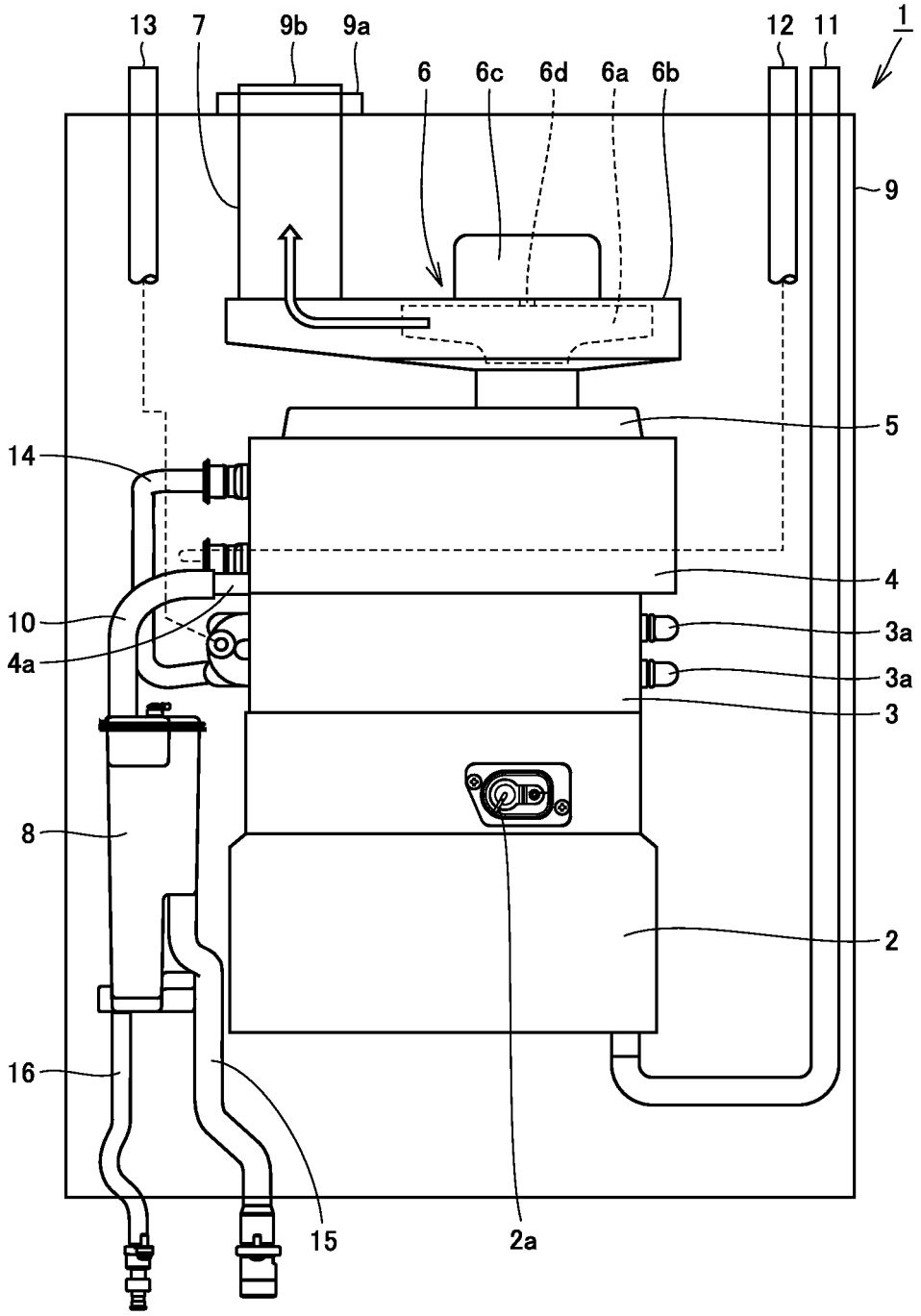
FIG. 16 is a front view schematically showing the configuration of a water heater as an example of the combustion apparatus included in the exhaust structure for combustion apparatus in one embodiment of the present invention.
Figure 17:
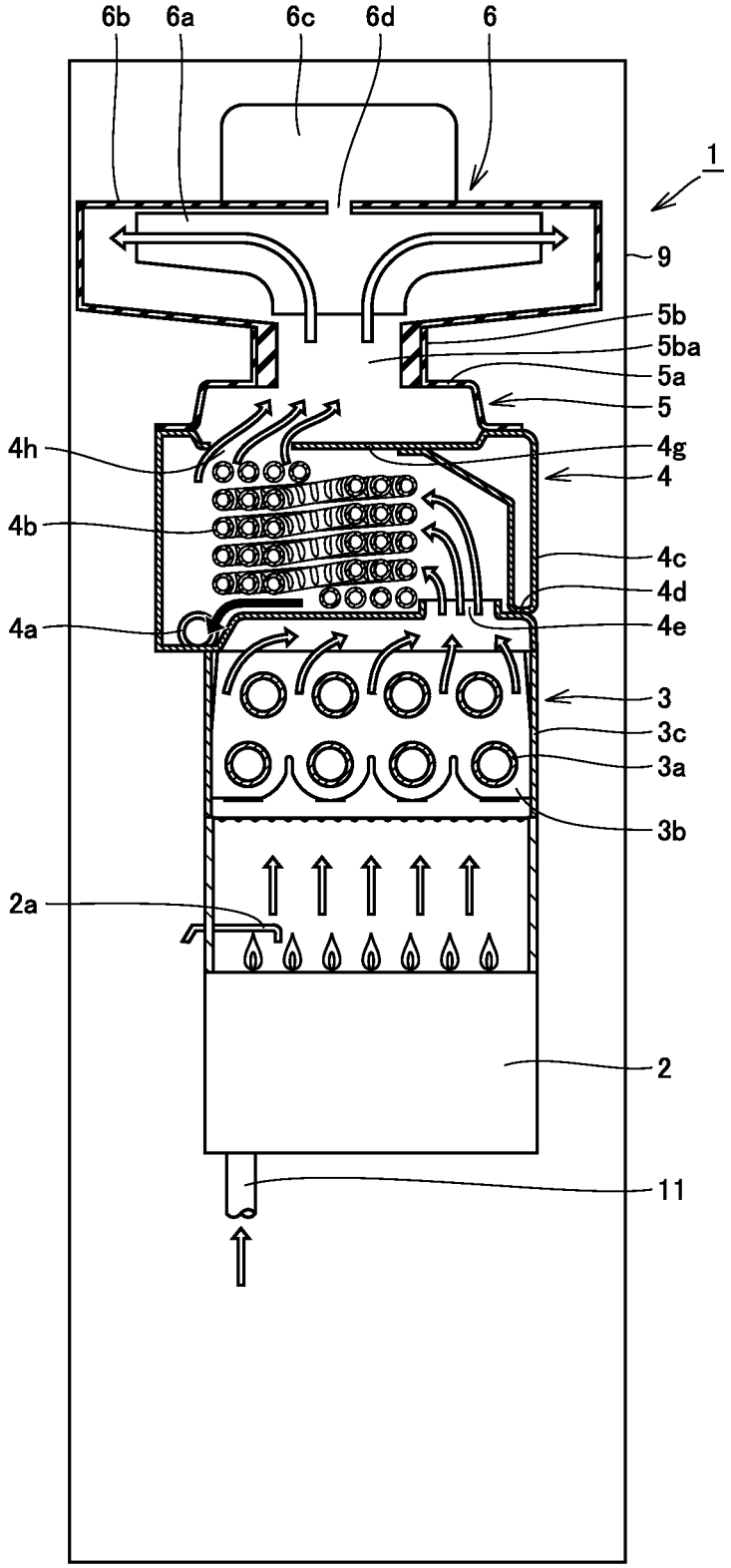
FIG. 17 is a partial cross-sectional side view schematically showing the configuration of the water heater shown in FIG. 16.

As shown in FIGS. 16 and 17, combustion apparatus 1 mainly has a burner 2, a primary heat exchanger 3, a secondary heat exchanger 4, an exhaust box 5, a fan 6, a connection pipe 7, a drainage water tank 8, a housing 9, and pipes 10 to 16.

Burner 2 serves to produce combustion gas by burning fuel gas. A gas supply pipe 11 is connected to burner 2. This gas supply pipe 11 serves to supply fuel gas to burner 2. A gas valve (not shown) implemented, for example, by an electromagnetic valve is attached to this gas supply pipe 11.

A spark plug 2*a* is disposed above burner 2. This spark plug 2*a* serves to ignite an air fuel mixture injected from burner 2 to thereby produce a flame, by generating sparks between the plug and a target (not shown) provided in burner 2 by activating an ignition device (an igniter). Burner 2 generates a quantity of heat by burning fuel gas supplied from gas supply pipe 11 (which is called a combustion operation).

Primary heat exchanger 3 is a heat exchanger of a sensible heat recovery type. This primary heat exchanger 3 mainly has a plurality of plate-shaped fins 3*b*, a heat conduction pipe 3*a* penetrating the plurality of plate-shaped fins 3*b*, and a case 3*c* accommodating fins 3*b* and heat conduction pipe 3*a*. Primary heat exchanger 3 exchanges heat with the combustion gas generated by burner 2, and specifically, it serves to heat hot water and water which flows through heat conduction pipe 3*a* of primary heat exchanger 3 with the quantity of heat generated as a result of the combustion operation of burner 2.

Secondary heat exchanger 4 is a heat exchanger of a latent heat recovery type. This secondary heat exchanger 4 is located downstream of primary heat exchanger 3 in a flow of the combustion gas and connected in series with primary heat exchanger 3. Since combustion apparatus 1 according to the present embodiment thus has secondary heat exchanger 4 of a latent heat recovery type, it serves as a water heater of a latent heat recovery type.

Secondary heat exchanger 4 mainly has a drainage water discharge port 4*a*, a heat conduction pipe 4*b*, a sidewall 4*c*, a bottom wall 4*d*, and an upper wall 4*g*. Heat conduction pipe 4*b* is layered as it is spirally wound. Sidewall 4*c*, bottom wall 4*d* and upper wall 4*g* are arranged to surround heat conduction pipe 4*b*.

In secondary heat exchanger 4, hot water and water which flows through heat conduction pipe 4*b* is pre-heated (heated) through heat exchange with the combustion gas of which heat has been exchanged in primary heat exchanger 3. As a temperature of the combustion gas is lowered to approximately 60° C. through this process, moisture contained in the combustion gas is condensed so that latent heat can be obtained. In addition, latent heat is recovered in secondary heat exchanger 4 and moisture contained in the combustion gas is condensed, whereby drainage water is produced.

Bottom wall 4*d* serves as a partition between primary heat exchanger 3 and secondary heat exchanger 4, and it also serves as an upper wall of primary heat exchanger 3. This bottom wall 4*d* is provided with an opening portion 4*e*, and this opening portion 4*e* allows communication between a space where heat conduction pipe 3*a* of primary heat exchanger 3 is arranged and a space where heat conduction pipe 4*b* of secondary heat exchanger 4 is arranged. As shown by hollow arrows in FIG. 17, the combustion gas can flow from primary heat exchanger 3 to secondary heat exchanger 4 through opening portion 4*e*. In this embodiment, for the sake of simplification, although one common component is employed for bottom wall 4*d* of secondary heat exchanger 4 and the upper wall of primary heat exchanger 3, an exhaust collection and guide member may be connected between primary heat exchanger 3 and secondary heat exchanger 4.

Upper wall 4*g* is provided with an opening portion 4*h*, and this opening portion 4*h* allows communication between the space where heat conduction pipe 4*b* of secondary heat exchanger 4 is arranged and an internal space in exhaust box 5. As shown by hollow arrows in FIG. 17, the combustion gas can flow from secondary heat exchanger 4 into the internal space in exhaust box 5 through opening portion 4*h*.

Drainage water discharge port 4*a* is provided in sidewall 4*c* or bottom wall 4*d*. This drainage water discharge port 4*a* opens at a lowest position in the space surrounded by side wall 4*c*, bottom wall 4*d* and upper wall 4*g* (the lowermost position in the vertical direction in the state where the water heater is placed), which is lower than the lowermost portion of heat conduction pipe 4*b*. Thus, drainage water produced in secondary heat exchanger 4 can be guided to drainage water discharge port 4*a* along bottom wall 4*d* and sidewall 4*c* as shown by a black arrow in FIG. 8.

Exhaust box 5 forms a path for a flow of the combustion gas between secondary heat exchanger 4 and fan 6. This exhaust box 5 can guide, to fan 6, the combustion gas of which heat has been exchanged in secondary heat exchanger 4. Exhaust box 5 is attached to secondary heat exchanger 4 and located downstream of secondary heat exchanger 4 in the flow of the combustion gas.

Exhaust box 5 mainly has a box main body 5*a* and a fan connection portion 5*b*. An internal space in box main body 5*a* communicates through opening portion 4*h* in secondary heat exchanger 4 with the internal space where heat conduction pipe 4*b* of secondary heat exchanger 4 is arranged. Fan connection portion 5*b* is provided so as to protrude from an upper portion of box main body 5*a*. This fan connection portion 5*b* has, for example, a cylindrical shape, and an internal space 5*ba* thereof communicates with the internal space in box main body 5*a*.

Fan 6 serves to emit the combustion gas (of which heat has been exchanged in secondary heat exchanger 4), which has passed through secondary heat exchanger 4, to the outside of combustion apparatus 1 by suctioning the combustion gas. This fan 6 is located downstream of exhaust box 5 and secondary heat exchanger 4 in the flow of the combustion gas. Namely, in combustion apparatus 1, burner 2, primary heat exchanger 3, secondary heat exchanger 4, exhaust box 5, and fan 6 are arranged in this order from upstream to downstream in the flow of the combustion gas produced in burner 2. Since the combustion gas is suctioned and exhausted by means of fan 6 as above in this arrangement, combustion apparatus 1 in the present embodiment serves as a water heater adapted to the exhaust suction and combustion system.

Fan 6 mainly has an impeller 6*a*, a fan case 6*b*, a drive source 6*c*, and a rotation shaft 6*d*. Fan case 6*b* is attached to fan connection portion 5*b* of exhaust box 5 such that the internal space in fan case 6*b* and the internal space in fan connection portion 5*b* communicate with each other. Thus, as shown by the hollow arrows in FIG. 17, the combustion gas can be suctioned from box main body 5*a* of exhaust box 5 through fan connection portion 5*b* into fan case 6*b*.

Impeller 6*a* is arranged in fan case 6*b*. This impeller 6*a* is connected to drive source 6*c* with rotation shaft 6*d* interposed therebetween. Thus, impeller 6*a* is provided with drive force from drive source 6*c* and can rotate around rotation shaft 6*d*. By rotation of impeller 6*a*, the combustion gas in exhaust box 5 can be suctioned from the inner circumferential side of impeller 6*a* and can be emitted to the outer circumferential side of impeller 6*a*.

Connection pipe 7 is connected to a region within fan case 6*b*, on the outer circumferential side of a region where impeller 6*a* is arranged. Therefore, the combustion gas emitted to the outer circumferential side of impeller 6*a* by impeller 6*a* of fan 6 can be emitted into exhaust tube 20 through connection pipe 7.

The combustion gas produced by burner 2 as above is suctioned by fan 6 by rotation of impeller 6*a* above, so that the combustion gas can reach fan 6 after passage through primary heat exchanger 3, secondary heat exchanger 4 and exhaust box 5 in this order as shown by the hollow arrows in FIG. 17 and can be emitted to the outside of combustion apparatus 1.

Drainage water tank 8 serves to store drainage water produced in secondary heat exchanger 4. This drainage water tank 8 is connected to secondary heat exchanger 4 through pipe 10. Pipe 10 is connected to drainage water discharge port 4*a* of secondary heat exchanger 4. Thus, the drainage water produced in secondary heat exchanger 4 can be discharged to drainage water tank 8. A pipe 15 extending to the outside of combustion apparatus 1 is connected to drainage water tank 8. The drainage water stored in drainage water tank 8 can be discharged to the outside of combustion apparatus 1 through this pipe 15.

This drainage water tank 8 has a water seal structure. Namely, drainage water tank 8 has such a structure that, when a prescribed amount of drainage water is stored in drainage water tank 8, the stored drainage water cannot allow air to pass through drainage water tank 8. By such a water seal structure of drainage water tank 8, entry of air outside combustion apparatus 1 (outside air) into combustion apparatus 1 (secondary heat exchanger 4) through drainage water tank 8 via pipe 15 can be prevented.

It is to be noted that the lower portion of drainage water tank 8 is connected to a pipe 16 for discharging drainage water, separately from pipe 15. This pipe 16 (usually closed) for discharging drainage water is designed such that drainage water within drainage water tank 8 that cannot be discharged through pipe 15 can be discharged by opening this pipe 16 during maintenance and the like. Furthermore, drainage water tank 8 has an internal space that may contain a neutralizing agent (not shown) for neutralizing acidic drainage water.

A water supply pipe 12 is connected to one end of heat conduction pipe 4*b* of secondary heat exchanger 4 and a hot water delivery pipe 13 is connected to one end of heat conduction pipe 3*a* of primary heat exchanger 3. The other end of heat conduction pipe 3*a* of primary heat exchanger 3 and the other end of heat conduction pipe 4*b* of secondary heat exchanger 4 are connected to each other through a pipe 14. Each of gas supply pipe 11, water supply pipe 12 and hot water delivery pipe 13 described above leads to the outside, for example, in a top portion of combustion apparatus 1. Burner 2, primary heat exchanger 3, secondary heat exchanger 4, exhaust box 5, fan 6, drainage water tank 8, and the like are arranged in housing 9.

Housing 9 has a connection portion 9*a* and an exhaust portion 9*b*. Specifically, housing 9 has an upper surface provided with tubular connection portion 9*a* and tubular exhaust portion 9*b* that are concentrically arranged and protrude in the upward direction. In other words, connection portion 9*a* and exhaust portion 9*b* form a double-pipe structure.

Connection portion 9*a* is provided so as to surround the outer circumferential surface of exhaust portion 9*b*. Furthermore, a connection hole is provided in a region of housing 9 between the outer circumferential surface of exhaust portion 9*b* and the inner circumferential surface of connection portion 9*a*. An exhaust port is provided inside exhaust portion 9*b* of housing 9. The above-mentioned connection hole communicates with the inside of housing 9 while the above-mentioned exhaust port communicates with the inside of connection pipe 7. Accordingly, a gap provided between the outer circumferential surface of exhaust tube 20 and the inner circumferential surface of connection pipe 60 communicates with the internal space of housing 9 through the connection hole provided in housing 9. Furthermore, the combustion gas having flown through burner 2 is sent from connection pipe 7 to exhaust tube 20 via exhaust portion 9*b*.

Connection portion 9*a* is connected to connection pipe 60 on the one end portion 60*a* side thereof while exhaust portion 9*b* is connected to exhaust tube 20 on the one end portion 20*a* side thereof. In addition, exhaust portion 9*b* is connected also to connection pipe 7 housed within housing 9. For example, exhaust portion 9*b* is formed to protrude also downward in a tubular manner from the upper surface of housing 9, so that exhaust portion 9*b* and connection pipe 7 can readily be connected to each other.

Connection portion 9*a* and connection pipe 60 only have to be connected to each other so as to prevent leakage of the gas flowing therethrough. Similarly, exhaust portion 9*b* and exhaust tube 20 (and connection pipe 7) only have to be connected to each other so as to prevent leakage of the gas flowing therethrough. Accordingly, an O-ring may be interposed between these components connected to each other, or these components may be firmly bound using a binding band. It is to be noted that connection between these components may be implemented by an inner cover or an outer cover.

Then, the functions and effects of the present embodiment will be described.

According to the present embodiment, attaching portions 53 and 54 have first cylindrical portion 54 and second cylindrical portion 53 that are different in inner diameter as shown in FIG. 3, which can therefore readily accommodate even such a situation where the diameter of the already-placed exhaust pipe 30 varies depending on the installation position as shown in FIGS. 4 and 5.

Furthermore, exhaust tube fixing member 50 is formed of an elastic body. Thereby, with the elasticity of exhaust tube fixing member 50, exhaust tube 20 can readily be connected to first fixing portion 51 and exhaust pipe 30 can readily be attached to attaching portions 53 and 54, as shown in FIGS. 4 and 5.

Furthermore, first cylindrical portion 54 and second cylindrical portion 53 are arranged concentrically. Thereby, exhaust tube 20 and exhaust pipe 30 can be stably attached to exhaust tube fixing member 50.

Furthermore, as shown in FIG. 3, exhaust tube fixing member 50 includes flange portion 55. Flange portion 55 is provided in the attaching portion (first cylindrical portion 54) and protrudes from the outer circumferential surface of the attaching portion (first cylindrical portion 54) toward the outer circumferential side. Thereby, exhaust tube fixing member 50 can readily be fixed by flange portion 55 to ceiling 220 or the like inside the building, as shown in FIGS. 4 and 5.

Furthermore, as shown in FIG. 12, seal member 90 is arranged in contact with the upper end surface of flange portion 55 (the surface of flange portion 55). This seal member 90 has an insertion portion (a radially-shaped cut 90*a*, a through hole 90*b*, and the like) through which exhaust tube 20 can be inserted. Thereby, seal member 90 can be elastically deformed and come in close contact with exhaust tube 20 in the state where exhaust tube 20 is inserted through the insertion portion. Thereby, the exhaust gas having leaked from the inside to the outside of exhaust tube 20 can be suppressed from leaking to the outside of exhaust pipe 30.

Furthermore, as shown in FIGS. 2 and 3, at least one of first cylindrical portion 54 and second cylindrical portion 53 is provided with through holes 54*a* and 53*a*. When exhaust pipe 30 is fixed to one of first cylindrical portion 54 and second cylindrical portion 53, this one cylindrical portion is extended in the circumferential direction. At this time, through holes 54*a* and 53*a* are provided in one of the cylindrical portions, so that a portion of this one cylindrical portion extended in the circumferential direction can be accommodated by these through holes 54*a* and 53*b*. Consequently, exhaust pipe 30 can readily be fixed to one of the first and second cylindrical portions.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

What is claimed is:

1. An exhaust structure for combustion apparatus, comprising an exhaust tube connected to a combustion apparatus, an exhaust pipe through which said exhaust tube is introduced, and an exhaust tube fixing member for fixing a position of said exhaust tube relative to said exhaust pipe, said exhaust tube fixing member including a fixing portion having a cylindrical shape and fixed to said exhaust tube, and an attaching portion connected to said fixing portion and attached to said exhaust pipe, and said attaching portion including a first cylindrical portion having a first inner diameter, and a second cylindrical portion having a second inner diameter smaller than said first inner diameter of said first cylindrical portion, said second cylindrical portion having a first end and a second end, being connected to said fixing portion at said first end side, and being connected to said first cylindrical portion at said second end, and an inner diameter of said second cylindrical portion is larger than an inner diameter of said fixing portion, wherein said exhaust tube fixing member further includes a flange portion, said flange portion is provided in said first cylindrical portion and protrudes from said first cylindrical portion toward an outer circumferential side, and said flange portion is connected to an upper end of said first cylindrical portion.

2. The exhaust structure for combustion apparatus according to claim 1, wherein said exhaust tube fixing member is formed of an elastic body.

3. The exhaust structure for combustion apparatus according to claim 1, wherein said first cylindrical portion and said second cylindrical portion are arranged concentrically.

4. The exhaust structure for combustion apparatus according to claim 1, wherein at least one cylindrical portion of said first cylindrical portion and said second cylindrical portion has a through hole penetrating through said at least one cylindrical portion from an inner circumferential side to an outer circumferential side.

5. The exhaust structure for combustion apparatus according to claim 1, further comprising a connection portion having a tubular shape and a first end and a second end, wherein the first end of said connection portion is connected to said fixing portion and the second end of said connection portion is connected to said second cylindrical portion.

* * * * *